United States Patent [19]

Crossman et al.

[11] Patent Number: 4,585,131

[45] Date of Patent: Apr. 29, 1986

[54] VARIABLE DECOR MERCHANDISING SYSTEM

[75] Inventors: Philip E. Crossman, Grand Rapids; Douglas D. Amstutz; Donald D. Kelemen, both of Muskegon, all of Mich.

[73] Assignee: Amstore Corporation, Muskegon, Mich.

[21] Appl. No.: 563,063

[22] Filed: Dec. 19, 1983

[51] Int. Cl.[4] ..... A47F 5/00

[52] U.S. Cl. ..... 211/206; 52/288; 211/183; 211/189

[58] Field of Search ..... 211/182, 183, 191, 189, 211/186, 187; 52/129, 288, 254, 312, 716, 735, 715

[56] References Cited

U.S. PATENT DOCUMENTS

| | | | |
|---|---|---|---|
| 701,079 | 5/1902 | Peokham . | |
| 918,039 | 4/1909 | Grundmann . | |
| 1,458,563 | 6/1923 | Walker . | |
| 2,201,387 | 5/1940 | Churchill | 189/88 |
| 2,877,515 | 3/1959 | Haas | 20/56.5 |
| 2,909,819 | 10/1959 | Fernberg | 24/73 |
| 2,933,196 | 4/1960 | Childs | 211/183 |
| 2,963,131 | 12/1960 | Brockway | 189/38 |
| 3,105,323 | 10/1963 | Esler et al. | 45/138 |
| 3,108,666 | 10/1963 | Holton | 189/88 |
| 3,131,792 | 5/1964 | Groneman et al. | 189/34 |
| 3,143,981 | 8/1964 | Tassell | 108/108 |
| 3,180,457 | 4/1965 | Bohnsack | 189/34 |
| 3,182,812 | 5/1965 | Fenwick | 211/148 |
| 3,190,454 | 6/1965 | Brooks | 211/71 |
| 3,280,527 | 10/1966 | Faust | 52/301 |
| 3,303,626 | 2/1967 | Brigham | 52/586 |
| 3,318,061 | 5/1967 | Stentz | 52/288 |
| 3,355,852 | 12/1967 | Lally | 52/725 |
| 3,370,389 | 2/1968 | Macaluso | 52/239 |
| 3,475,870 | 11/1969 | Birum, Jr. | 52/211 |
| 3,492,770 | 2/1970 | Furner | 52/400 |
| 3,537,736 | 11/1970 | Kroopp | 287/54 |
| 3,653,698 | 4/1972 | Jenner | 287/189 |
| 3,679,164 | 7/1972 | Bard | 248/243 |
| 3,722,700 | 3/1973 | Cummings | 211/153 |
| 3,744,826 | 7/1973 | Hawes | 287/189.36 |
| 3,807,320 | 4/1974 | Textoris | 108/106 |
| 3,810,340 | 5/1974 | Nelsson | 52/729 |
| 3,866,758 | 2/1975 | Strassle | 211/107 |
| 3,884,002 | 5/1975 | Logie | 52/285 |
| 3,925,939 | 12/1975 | Costruba | 52/36 |
| 3,974,610 | 8/1976 | Logie | 52/285 |
| 4,012,880 | 3/1977 | Logie | 52/585 |
| 4,064,995 | 12/1977 | Bustos | 211/187 |
| 4,065,904 | 1/1978 | Taylor et al. | 52/731 |
| 4,067,155 | 1/1978 | Ruff et al. | 52/105 |
| 4,109,981 | 8/1978 | Pfaehler | 312/107 |
| 4,113,110 | 9/1975 | Mittag | 211/191 |
| 4,126,978 | 11/1978 | Heller | 52/461 |
| 4,133,433 | 1/1979 | Wolf | 211/192 |
| 4,161,853 | 7/1979 | Weiss et al. | 52/288 |
| 4,185,422 | 1/1980 | Radek | 52/36 |
| 4,272,941 | 6/1981 | Hasselbacker et al. | 52/731 |
| 4,315,390 | 2/1982 | Schaafsma | 52/288 |

FOREIGN PATENT DOCUMENTS

| | | |
|---|---|---|
| 648973 | 6/1964 | Belgium . |
| 802586 | | United Kingdom . |
| 1133931 | | United Kingdom . |

*Primary Examiner*—Robert W. Gibson, Jr.

*Attorney, Agent, or Firm*—Price, Heneveld, Huizenga & Cooper

[57] ABSTRACT

The specification discloses a modular merchandising display system including a plurality of upright members, a plurality of lateral members interconnecting the upright members, and a plurality of decor strips releasably mounted on and encapsulating each upright member. Each decor strip includes two flexible sides, each of which is adjacent an edge of another decor strip on the upright member so that the upright members are hidden. The lateral members extend between adjacent sides, which flex to accommodate the lateral member.

29 Claims, 15 Drawing Figures

VARIABLE DECOR MERCHANDISING SYSTEM

BACKGROUND OF THE INVENTION

The present invention relates to merchandising display systems, and more particularly modular merchandising display systems.

Modular merchandising display systems have gained wide-spread popularity because they may be initially assembled, and subsequently rearranged, readily and easily, into a variety of configurations. Typically, such a system includes a plurality of upright members releasably interconnected by a plurality of horizontal members. The horizontal members include bars from which clothes may be hung and support members for shelves, drawers, or cabinet units. In the most adaptable systems, the upright members include vertical mounting tricks, for receiving the horizontal members at a plurality of vertical positions.

However, known modular merchandising display systems typically have an unsightly appearance because (1) the vertical mounting tracks, which receive the horizontal members, are visible along the entire height of the upright members and (2) the connections between the horizontal and upright members are visible. Second, refinishing the modular components to make decor changes is difficult. The entire system must be disassembled, refinished, and then reassembled. Often, the components must be sent out of the store to one who specializes in refinishing. Due to the inconvenience and expense of refinishing, many merchandisers are hesitant to alter the decor of their displays. Third, installing electric and other wiring through the assembled system, for example to provide lighting, is also difficult. Although the modular components are generally tubular forcing wiring through these typically long members is difficult.

Prior attempts at dressing up these modular systems are inadequate. In one such system, decor strips are laminated directly to the upright member between each pair of adjacent vertical mounting tracks. See U.S. Pat. No. 4,133,433, entitled MERCHANDISING DISPLAY SYSTEM and issued Jan. 9, 1979, to Wolf. Although the upright members are somewhat dressed up in such a system, the vertical tracks, as well as the connections of the horizontal members to the upright members, are exposed. Second, relaminating the upright members to make a decor change is difficult. The old strips must be carefully removed and the replacement strips carefully positioned and relaminated. Further, this system does not provide means for conveniently receiving wiring.

SUMMARY OF THE INVENTION

The aforementioned problems are solved by the present invention wherein a modular merchandising display system is provided wherein each upright member is encapsulated within a decor system, releasably mounted on the upright member and adapted to receive horizontal members connected to the upright members. The decor system of the merchandising display system of the present invention hides the upright members and hides the interconnection of the horizontal members with the upright members. The decor system is easily removed from the upright members and replaced with a decor system having a different appearance to give the merchandising system a totally different appearance at relatively low expense and little inconvenience.

More particularly, the merchandising display system comprises an upright member and a plurality of decor strips releasably mounted on the upright member in side-to-side relationship to hide the upright member and to hide the connections of lateral members to the upright member. The sides of the decor strips are flexible to receive and accommodate the lateral member extending therebetween.

In a preferred embodiment of the invention, the merchandising system further comprises means for spacing the decor strips from the upright members to provide a wire raceway therebetween.

These and other objects, advantages, and features of the invention will be more fully understood and appreciated by reference to the written specification and appended drawings.

DETAILED DESCRIPTION OF THE PREFERRED EMBODIMENTS

First Preferred System Embodiment

Figure 1:
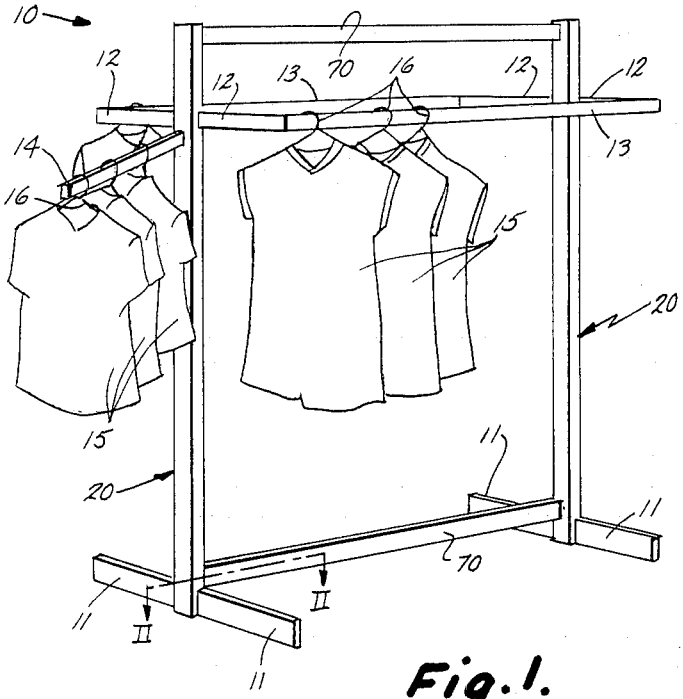
FIG. 1 is a perspective view of a display rack constructed of the modular components of the merchandising display system of the present invention.

A merchandising display system 10 (FIG. 1) constructed in accordance with a preferred embodiment of the invention includes a plurality of upright assemblies 20, a pair of feet 11 extending from and supporting each upright assembly 20 on the floor, and horizontal members 70 interconnecting the upright assemblies. Upright assemblies 20 also support hanger bars 13, upon which garments 15 may be hung or suspended on hangers 16 for display. Each assembly 20 (FIG. 2) includes upright member 30 and decor strips 50 releasably mounted thereon and arranged in side-by-side relationship to completely encapsulate or hide the upright member. Each of strips 50 includes two opposite sides 60 which flex to accommodate horizontal member 70 (FIGS. 2 and 3), which is connected to upright assembly 20, and more particularly upright member 30, using connecting assembly 80.

Figure 4:
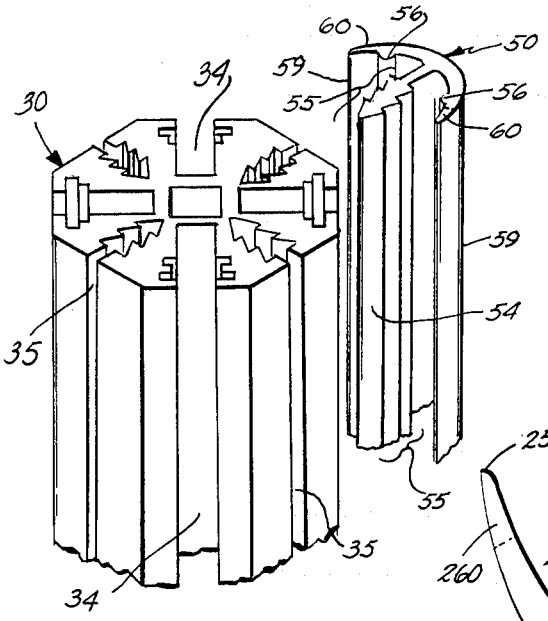
FIG. 4 is an exploded, perspective view of an upright member and a single decor strip.

Upright member 30 (FIGS. 2 and 4) is preferably an extrusion of aluminum. Other materials having the required structural rigidity may also be used. Four integral core walls 31 (FIG. 2), define hollow core 32, which has a generally square cross section. Extending outwardly from each junction of two core walls 31 are a pair of channel walls 33*a* and 33*b*, which alternately define mounting tracks 34 and decor strip channels 35. Each of tracks 34 extends the full height of member 30 and is generally uniform in width along its height with the exception of plate slot 37 which is somewhat wider than the channel. Each of slots 37 include a base portion 37*a* slightly wider and positioned outwardly from step portion 37*b*. A pair of securing flanges 36*a* and 36*b* extend toward one another from adjacent walls 33*a* and 33*b*, respectively, across each channel 34. Alternating with mounting tracks 34 about the periphery of upright member 30 are decor strip channels 35, each of which is barbed as indicated at 38.

Each of decor strips 50 (FIGS. 2 and 4) is generally the same length as the upright member 30 upon which it is mounted. Further, each strip 50 includes a decorative body portion 51 having a visible side 52 and an underside 53 and a flange 54, barbed as indicated at 55. Body portion 51 includes sides 59 which extend longitudinally thereof. Immediately proximate sides 59 are side margin portions 60, which are relatively flexible as compared to the remainder of body portion 51. Preferably, decor strips 50 are extrusions of dual durometer polyvinyl chloride with margin portions 60 having a relatively low durometer and the remainder of strips 50 having a relatively high durometer. Spacing bumpers 56 extend from underside 53 along the full length of strip 50 mediate each margin portion 60 and flange 54. A raceway 57 is defined adjacent each bumper 56 by the bumper, body portion 51, flange 54, and upright member 30. Wire and cable may be positioned in each of raceways 57 and is completely hidden in assembled system 10. Visible side 52 of strips 50 are provided with an attractive appearance, for example wood grain or chrome.

Horizontal members 70 (FIGS. 2, 3, and 6) are preferably fabricated from cold-rolled steel and provided with a zinc finish. As most clearly shown in FIG. 3, horizontal members 70 are generally rectangular in cross section and tubular. Further, each horizontal member includes a member end 71 secured to connecting assembly 80.

Connection assembly 80 (FIGS. 2 and 6) includes rectangular abutment plate 81, rectangular track plate 82 and screws 83. Plate 81 is secured to horizontal member end 71, preferably by welding, and defines beveled plate apertures 85. Track plate 82 defines a pair of internally threaded collar apertures 86 (FIG. 6) and is substantially the same width as plate slot 37. Each of screws 83 is threadedly secured in plate 82 and rotatably seated in plate aperture 85.

Assembly and Operation

Merchandising display system 10 is readily and easily assembled by first connecting horizontal members 70 to upright members 30. One screw 83 is positioned in each plate aperture 85 and initially threaded into one of track plate apertures 86. Track plate 82 is then slid into mounting track 34, and more particularly plate slot 37. At this point, abutting plate 81 lies loosely adjacent securing flanges 36*a* and 36*b*. Connecting assembly 80 is then slid along upright member 30 with plate 82 sliding within slot 37 until lateral member 70 is properly oriented with respect to the upright member. Screws 83 are then tightened drawing track plate 82 toward abutting plate 81 entrapping securing flanges 36*a* and 36*b* therebetween.

After horizontal members 70 have been secured to upright members 30, feet 11, hanger bar supports 12, and side bars 14 are connected to uprights 30 in a similar fashion. Additionally, a hanger bar 13 is secured between each pair of hanger bar supports 12.

At any time during assembly, decor strips 50 are mounted on each of upright members 30. Flange 54 of each decor strip 50 is press-fitted into one of decor strip channels 35 so that barbs 55 on the flange engage barbs 38 within the channel to secure the flange therein. When flange 54 is fully inserted, spacing bumpers 56 engage channel walls 33 to space underside 53 from the channel walls to define wire raceway 57 therebetween.

Figure 3:
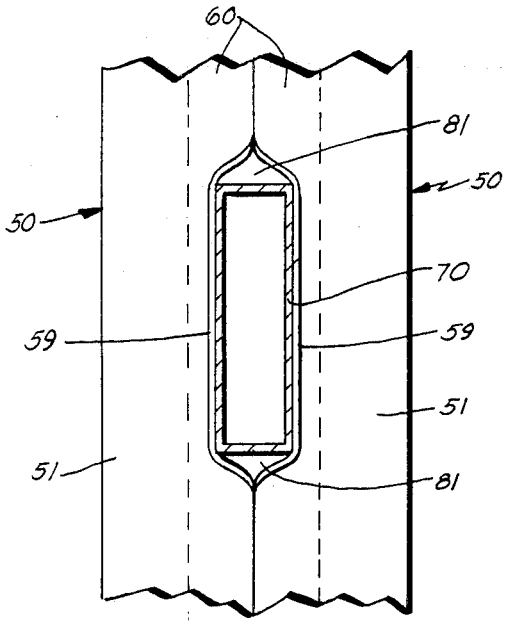
FIG. 3 is a sectional view taken along plane III—III in FIG. 2.
Figure 6:
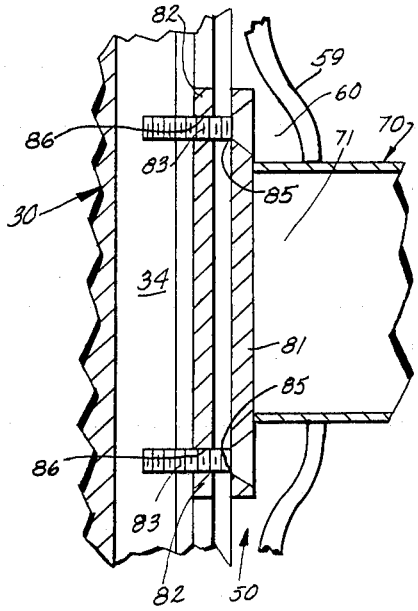
FIG. 6 is a sectional view taken along plane VI—VI in FIG. 2.
Figure 2:
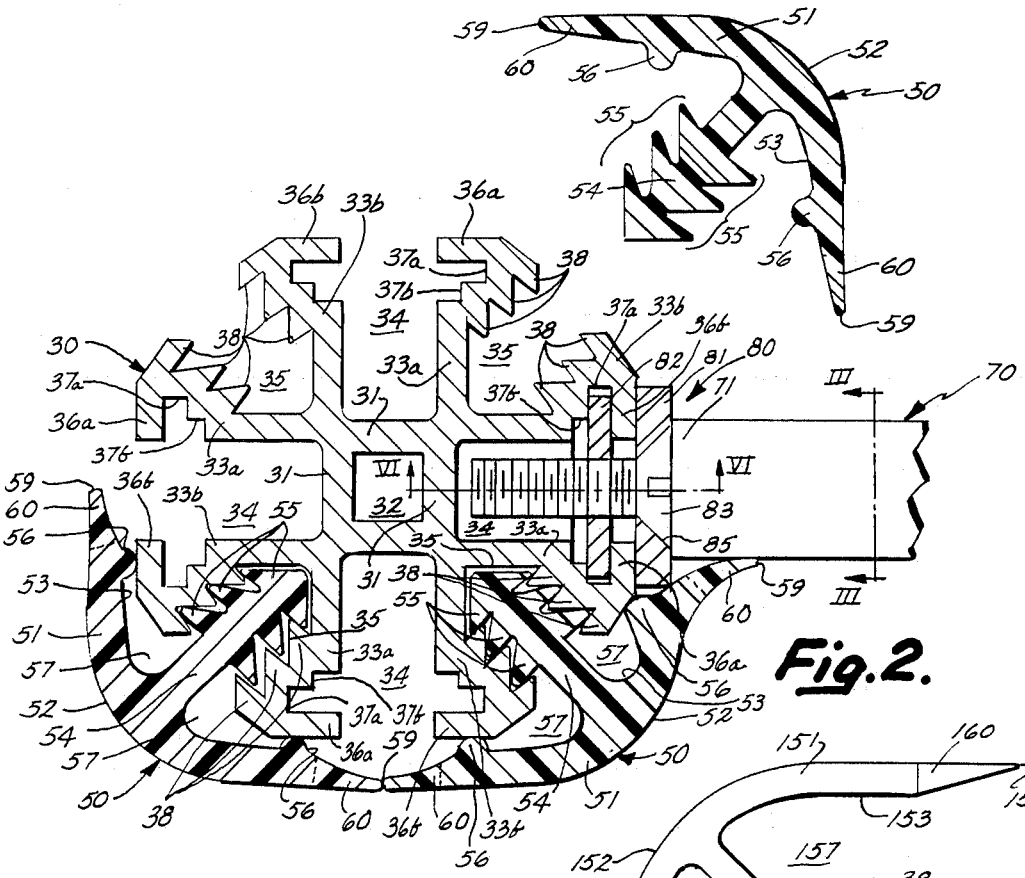
FIG. 2 is a sectional view taken along plane II—II in FIG. 1.

When four decor strips 50 have been mounted on upright 30, sides 59 of adjacent decor strips are closely adjacent, or proximate one another, preferably abutting one another (FIGS. 2 and 3) except at lateral members 70. Margin portions 60 flex to receive and accommodate horizontal member 70 extending therebetween (FIGS. 2, 3, and 6). Although a small portion of mounting plate 81 is visible both above and below horizontal member 70 (FIG. 3), the decor strips substantially hide both upright member 30 and the connection of horizontal member end 71 to upright member 30. If decor strips 50 are installed after horizontal member 70, margin portions 60 flex as necessary to accommodate the horizontal members as the strips are press-fitted into position. On the other hand, if decor strips 50 are installed prior to horizontal members 70, margin portions 60 flex as horizontal member 70 is slid within channel 34.

A wire (not shown) may be positioned in any one of raceways 57 using one of two procedures. In the first procedure, the wire is placed proximate both flange 54 and underside 53 adjacent raceway 57 prior to installation of strip 50. As decor strip 50 is press-fitted into upright member 30, the wire is entrapped within raceway 57 between channel wall 33, body portion 51, bumper 56, and flange 54. In the second procedure, decor strip 50 is installed on upright 30 prior to wire installation. The wire is then slid into raceway 57 between bumper 56 and upright 30 with body portion 51 flexing to receive the wire.

A decor change of display system 10, and more particularly of upright assemblies 20, is easily and readily accomplished. Decor strips 50 mounted on upright members 30 are removed by withdrawing flanges 54 from decor strip channels 35. New decor strips, having a different appearance, or finish, on visible surface 52 are then reinstalled to completely change the appearance of the upright members. Upright members 30 may be given a wood grain appearance, chromed finish, or virtually any other appearance merely by the proper selection of decor strips 50.

Alternative Decor Strips for First System Embodiment

Figure 5A:
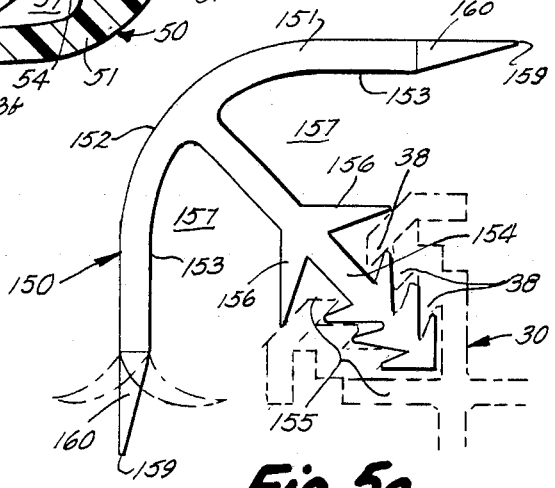
FIG. 5*a* is a sectional view of an alternative embodiment of the decor strip with a portion of an upright member shown in phantom.
Figure 5B:
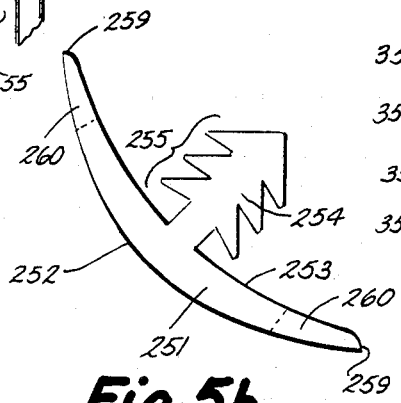
FIG. 5*b* is a sectional view of another alternative embodiment of the decor strip.
Figure 5C:
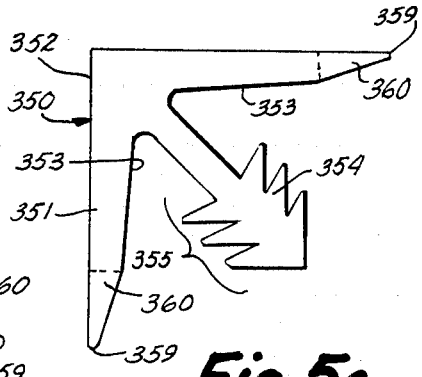
FIG. 5*c* is a sectional view of yet another alternative embodiment of the decor strip.

Decor strips 50 may be fabricated so that body portion 51 has virtually any cross section. Three such examples are shown in FIGS. 5*a*, 5*b*, and 5*c*. Decor strip 150 (FIG. 5*a*) provides a relatively large raceway 157 between body portion 151 and an upright member 30. Generally, strip 150 includes curvilinear body portion 151 having visible surface 152 and underside 153 from which flange 154 extends. The terminal portion 155 of flange 154 is barbed to facilitate its securement within upright member 30. Body portion 151 terminates in opposite sides 159 which extends generally longitudinally of the strip. Immediately proximate sides 159 are flexible margin portions 160 which flex to accommodate a horizontal member. Finally, biasing projections 156 extend from flange 154 to engage upright member 30 to bias the barbed portion 155 into tighter engagement with barbs 38 on the upright member.

Decor strip 250 (FIG. 5*b*) includes a curvilinear body portion 251 having a finished visible surface 252 and an underside 253 from which barbed flange 254 extends. Body portion 251 terminates in opposite side 259, which extend generally longitudinally of strip 250. Immediately proximate sides 259 are flexible margin portions 260, which flex to receive horizontal members.

Finally, alternative decor strip 350 (FIG. 5*c*) comprises L-shaped body portion 351 including surface 352 and underside 353 from which flange 354 extends. The terminal portion of flange 354 is barbed to facilitate its securement within an upright member. Body portion 351 terminates in opposite flexible margin portions 360, which in turn terminates in sides 359, which extend generally longitudinally of strip 350.

In alternative strips 150, 250, and 350, the exterior surfaces of the decorative bodies are finished, for example in wood grain or chrome. When strip 150 is mounted on upright member 30, biasing barbs 156 engage the upright member while in strips 250 and 350, under sides 253 and 353 engage the upright member. Further, four of either strips 150, 250, or 350 are mounted on each upright 30 so that their sides are closely proximate one another to hide the upright member. Horizontal members 70 may be inserted through adjacent sides and secured to upright member 30 using connecting assembly 80. The margin portions adjacent horizontal member 70 flex to receive and accommodate the member.

Second Preferred System Embodiment

Figure 7:
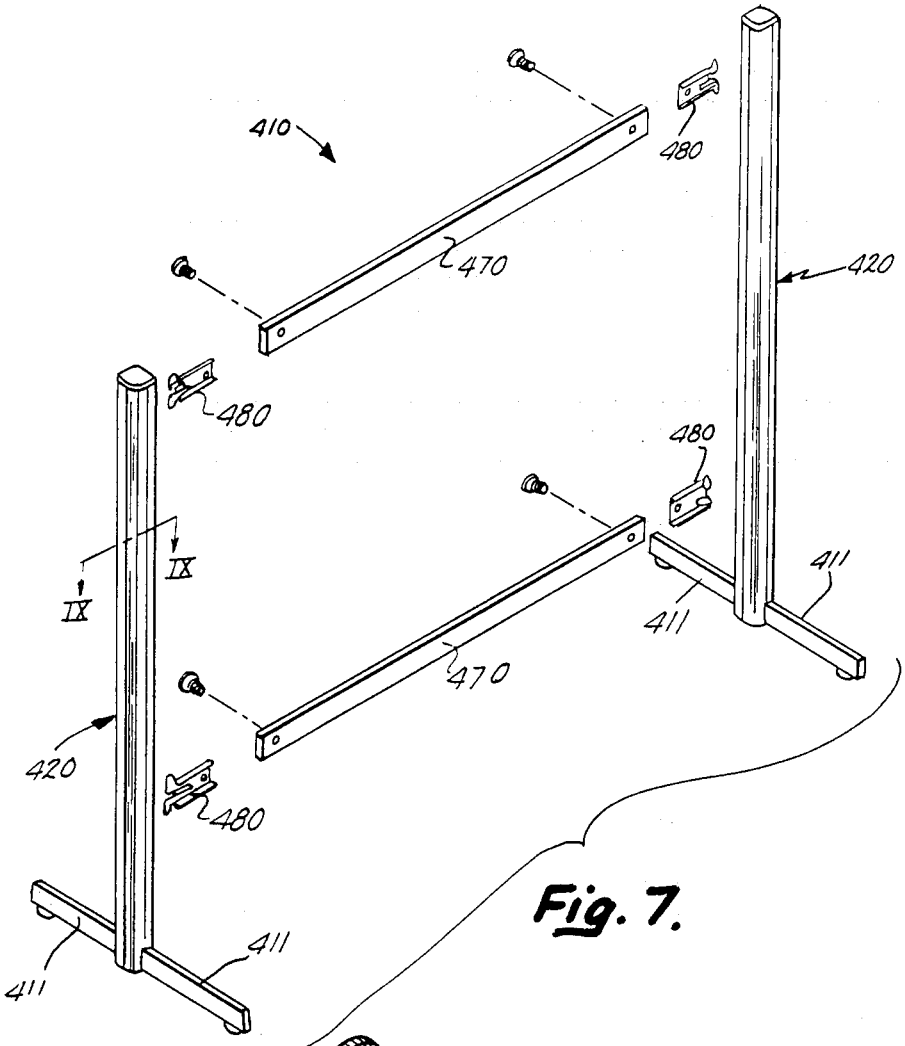
FIG. 7 is a perspective, exploded view of a display rack constructed of modular components of an alternative embodiment of the merchandising display system.

An alternative, and currently the preferred, embodiment 410 of the modular display system is illustrated in FIGS. 7–10. As seen in FIG. 7, the basic components of system 410 are generally similar to system 10 previously described and include a plurality of upright or post assemblies 420 supported on feet 411 and interconnected by crossbars 470. Connecting assemblies 480 are used to secure crossbars 470 to post assemblies 420. Feet 411 may include levelers as is generally well known to those having ordinary skill in the art to provide a means of leveling system 410.

Figure 8:
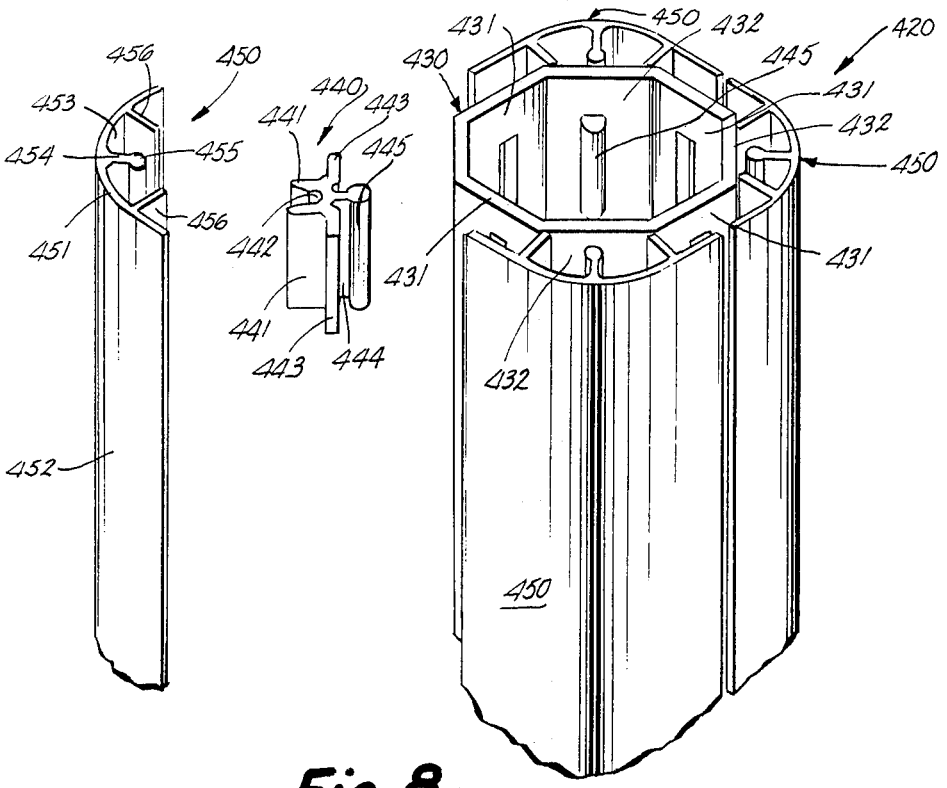
FIG. 8 is a perspective view of an upright member of the alternative system with one shroud and shroud clip exploded therefrom.
Figure 10:
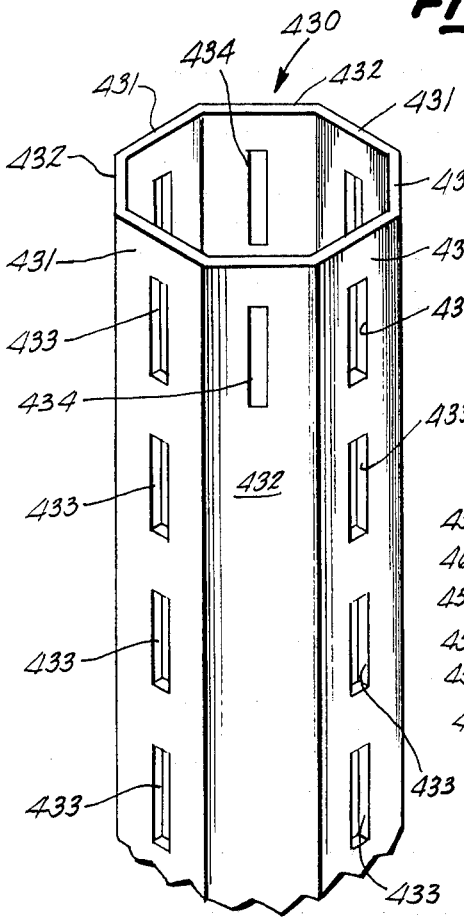
FIG. 10 is a perspective view of a post of the alternative system.
Figure 9:
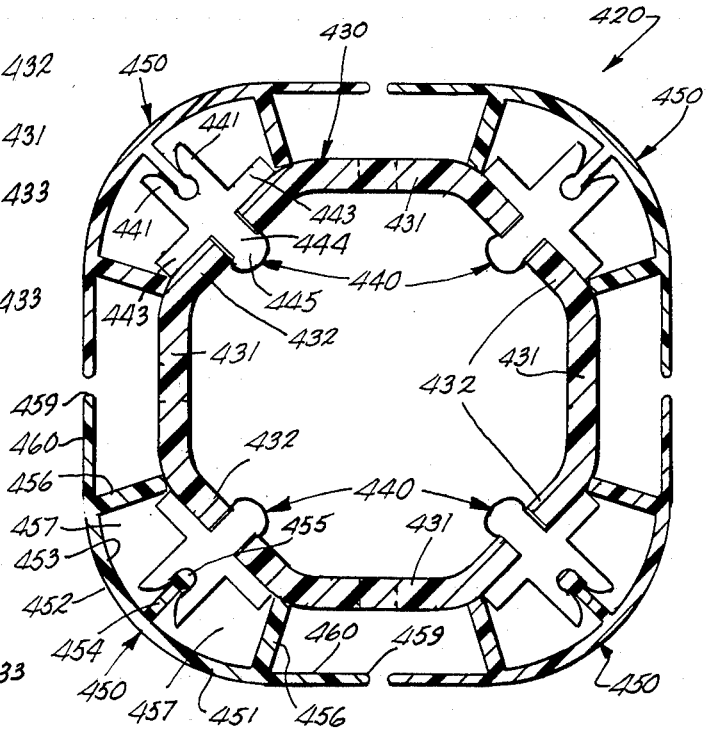
FIG. 9 is a sectional view taken along plane IX—IX in FIG. 7.

Post assembly 420 is illustrated in detail in FIGS. 8–10 and includes post 430, a plurality of shroud clips 440, and a plurality of shrouds or decor strips 450. Post 430 is a generally tubular member fabricated of steel and has a generally regular octagonal cross section (see FIG. 9). Consequently, post 430 includes four crossbar-support sides 431 alternating with four shroud-support sides 432. Each of crossbar-support sides 431 defines a plurality of longitudinally oriented, evenly spaced slots 433 along the length of post 430. Each of slots 433 is generally identical to one another and is designed to receive connectors 480 (see FIG. 7). The relatively frequent spacing of slots 433 enables crossbars 470 to be connected to post 430 at any one of a plurality of heights. Shroud-support sides 432 each define a plurality of slots 434 each of which is generally identical to slot 433. Slots 434 are spaced further apart from one another than are slots 433—for example, one of slots 434 is provided for each fifth slot 433.

A plurality of nylon shroud clips 440 is provided and preferably one for each slot 434 in shroud-support sides 432 of post 430. As seen in FIGS. 8 and 9, each of clips 440 comprises a pair of legs 441 defining a snap channel 442 therebetween. A pair of shoulders extend oppositely from one another at the base of legs 441. Neck 444 extends from between shoulders 433 and supports enlarged head 445 which may be snap-fit within post 430. When shroud clip 440 is properly installed on post 430 (FIG. 9), neck 444 extends through slot 434 with shoulders 443 abutting the outside of post 430 and head 445 abutting the inside of post 430.

Shroud or decor strip 450 (FIGS. 8 and 9) is somewhat similar to decor strip 50 previously described. Generally speaking, shroud 450 includes decorative body portion 451 having an outer or exposed surface 452 and an inner or hidden surface 453. Outer surface 452 is provided with a decorative appearance such as wood grain or an attractive color to enhance the appearance of assembled upright assemblies 420. Neck 454 extends from body 451 generally the full length of shroud 450 and terminates in an enlarged portion or head 455. In assembled upright 420, head 455 is snap-fittingly received within channel 442 of shroud clips 440. A pair of spacing ridges or bumpers 456 also extend from body 451 and abut post 430 to space underside 453 from post 430. Consequently, shroud 450 defines recess or wire raceway 457 which faces post 430 and extends substantially the entire height thereof. Margin portions 460 extend from body 451 beyond bumpers 456 and in the preferred embodiment are flexible as in decor strips 50. Margin portions 460 terminates in sides or edges 459 which are generally proximate one another on adjacent mounted shrouds 450. Hence, slots 433 as well as slots 434 on posts 430 are hidden by decor strips 450. Preferably, shrouds 450 are fabricated of dual-durometer polyvinyl chloride wherein body 451 and neck 454 have a first higher durometer, and margin portions 460 have a second lower durometer.

Connector 480 (FIGS. 11–13) generally includes hanger 481, slide lock 482, and camming screw 483. Hanger 481 includes a generally planar body portion 484 from which parallel reinforcement flanges 485 and 486 extend in a common direction. Circular land 487 is raised from body 484 in a direction generally common with flanges 485 and 487 and defines a threaded aperture 488 to receive camming screw 483.

Upper and lower ears 489 and 490, respectively, (FIGS. 11 and 12) extend through slots 491 and 492, respectively, in post 430. Legs 493 and 494 interconnect ears 489 and 490, respectively, with body 484. Ear 489 includes an upper portion 495 which extends upwardly from leg 493 such that the upper edge 496 of portion 495 is located behind the upper edge 491*a* of slot 491 regardless of the vertical position of leg 493 within slot 491. Ear 489 additionally includes a lower portion 497 which extends downwardly from leg 493 and terminates in edge 498 which can be inserted through slot 491 when leg 493 is elevated above the position illustrated in FIG. 12. Ear portion 497 is located behind lower edge 491*b* of slot 491 when hanger 481 is in the locked position shown in FIG. 12.

Figure 12:
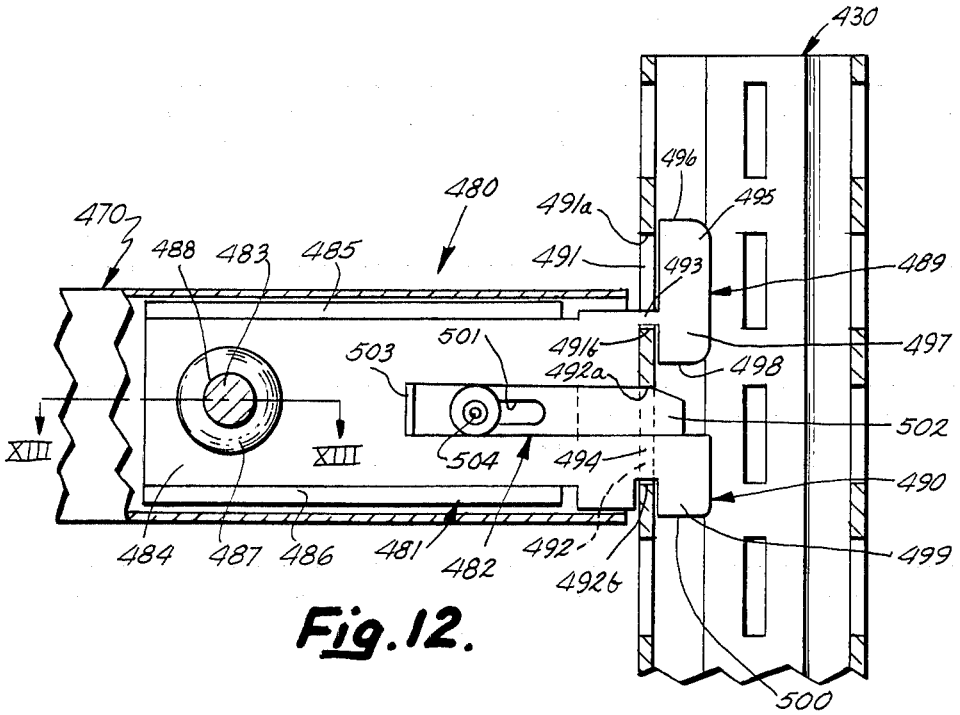
FIG. 12 is a sectional elevational view of the cross bar post interconnection showing the connector locking finger in the locked position.
Figure 13:
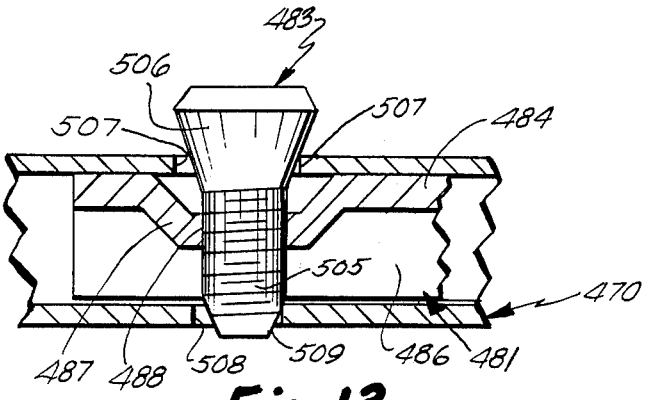
FIG. 13 is a sectional view taken along plane XIII—XIII in FIG. 12.

Ear 490 includes a lower portion 499 which extends downwardly from leg 494 to be located behind lower edge 492*a* of slot 492 when hanger 481 is in the position illustrated in FIG. 12. However, lower edge 500 of ear portion 499 can pass beyond lower edge 492*a* when hanger 481 is in an elevated or release position wherein legs 493 and 494 are proximate upper slot edges 491*a* and 492*a*, respectively.

Slide bar 482 is a generally elongated piece defining an elongated slot 501 mediate locking end or tab 502 and actuator 503. Pop rivet 504 extends through elongated slot 501 and is secured to body 484 to slidingly secure bar 482 to hanger 481. Actuator 503 of slide bar 482 facilitates the operation of the slide bar. Locking tab 502 extends substantially the entire height between leg 494 and upper edge 492*a* of slot 492. Consequently, when the slide bar is shifted to its locking position as illustrated in FIG. 12, leg 494 and locking tab 502 together extend substantially the entire height between upper and lower edges 492*a* and 492*b* to prevent movement of hanger 481 within post 430.

Cross member 470 is a tubular member generally rectangular in cross section having an internal height approximately equal to the height of body portion 484 and an internal width approximately the same as the width of flanges 485 and 486. Consequently, cross bar 470 is closely received on hanger 481. Cross bar 470 defines a pair of coaxially aligned apertures—larger aperture 507 and smaller aperture 508.

Camming screw 483 includes externally threaded portion 505 secured within threaded aperture 488 in body 484 and beveled head 506 extending therefrom and positioned within larger aperture 507. Threaded portion 505 terminates in chamfered tip 509. Beveled head 506 and aperture 507 cooperate, and tip 509 and aperture 508 cooperate, to provide camming action (FIG. 13) to force cross bar 470 toward upright 430 as the camming screw is tightened.

System 410 is assembled and used generally similarly to system 10 previously described. Feet 411 are connected to posts 430 using techniques generally well known in the art, for example welding, to provide a freestanding unit.

Figure 11:
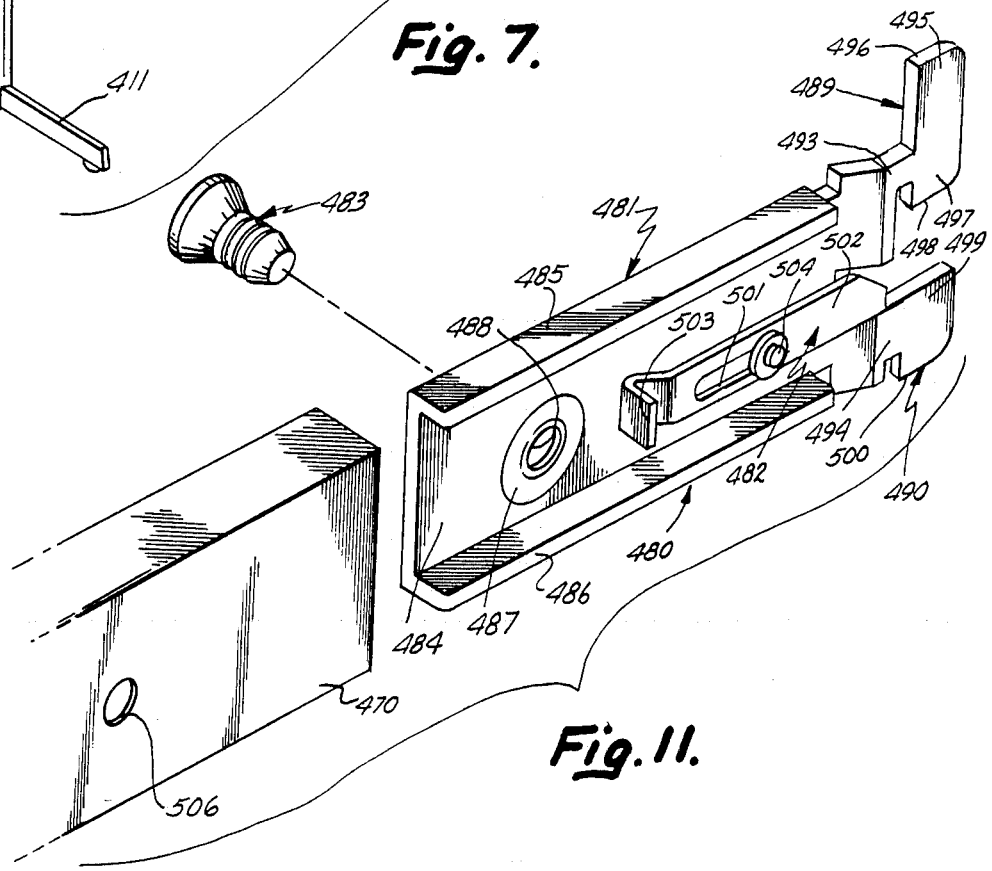
FIG. 11 is a perspective, exploded view of the cross bar to post connector showing the locking finger in the retracted position.

Cross bars 470 are secured to uprights 430 using connectors 480. Hanger 481 is first installed on upright 430 by retracting slide bar 482 to its release position as illustrated in FIG. 11. Hanger 481 is then hung on upright 430 by first inserting upper edge 496 through slot 491 and positioning leg 493 proximate upper slot edge 491*a*. Hanger 481 is then pivoted downwardly about leg 493 such that lower portion 497 of upper ear 489 and lower portion 499 of lower ear 490 pass through slots 491 and 492, respectively. Hanger 481 is then lowered into the locked position illustrated in FIG. 12 wherein upper lobe 495 is positioned behind upper slot edge 491*a* and wherein lower lobes 497 and 499 are positioned behind lower slot edges 491*b* and 492*b*, respectively. The hanger is secured in this locked position by shifting slide bar 482 into the locked position illustrated in FIG. 12 which prevents hanger 481 from shifting upwardly with respect to post 430. After hanger 481 has been secured to upright 430, cross bar 470 is telescoped over the hanger and camming screw 483 is inserted through aperture 507 and threaded into aperture 488. As camming screw 483 is tightened, beveled head 506 and chamfered tip 509 urges or cams cross bar 470 toward upright 430 to provide a tight lock therebetween. Cross bar 470 can be removed or repositioned along the height of upright 430 by reversing the above described steps.

At any time during assembly, shrouds 450 are mounted on each of posts 430. First, shroud clips 440 are mounted on post 430, and more particularly one shroud clip is snap-fitted into each slot 434. Shrouds 450 are then secured to posts 430 by snap-fitting head 455 of flange 454 into channel 442 in the shroud clips. When head 455 is fully inserted in channel 442, bumpers 456 engage post 430 to space body 451 therefrom and define wire raceway 457. Consequently, wires may be positioned within any one of raceways 457 as in the previously described system 10.

Any time that the store owner wishes a decor change, shrouds 450 are simply removed from upright assemblies 420; and new shrouds 450 having the desired new appearance are reinstalled within shroud clips 440.

It should be understood that the above descriptions are those of preferred embodiments of the invention. Various changes and alterations might be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A modular support system comprising:

an upright member;

a plurality of elongated decor strips each including first and second flexible, margin portions terminating in first and second edges, respectively, said edges extending longitudinally of said strips, said decor strips being mounted on said upright member with each of said edges proximate an edge of another decor strip to hide said upright member, whereby a lateral member extending between a pair of proximate edges and secured to said upright member causes the margin portions associated with the pair of proximate edges to flex to receive the lateral member and to hide the connection of said upright member and the lateral member.

2. A support system as defined in claim 1 wherein said decor strips are releasably mounted on said upright member.

3. A support system as defined in claim 1 wherein said upright member comprises receiving means and wherein each of said decor strips comprises projection means press-fitted into said receiving means to secure said decor strips to said upright member.

4. A support system as defined in claim 3 wherein both said receiving means and said projection means are barbed to aid in securing said projection means in said securing means.

5. A support system as defined in claim 3 wherein said receiving means comprises said upright member defining a plurality of mounting tracks extending substantially the full height of said upright member, and wherein each of said projection means comprises a flange extending substantially the full length of said decor strip.

6. A support system as defined in claim 1 wherein said upright member comprises means for receiving said lateral member at a plurality of vertical positions directly behind said proximate edges.

7. A support system as defined in claim 6 wherein said upright member comprises means for receiving an elongated member at a plurality of vertical positions directly behind each pair of proximate edges.

8. A support system as defined in claim 1 wherein at least one of said upright members and said decor strips comprise means for spacing a portion of a decor strip from said upright member to define a wire raceway therebetween.

9. A support system as defined in claim 8 wherein said means for spacing comprises a bumper extending from said decor strip and engaging said upright member.

10. A support system as defined in claim 1 wherein said decor strip includes a longitudinal recess generally throughout its length opening toward said upright member and defining a wire raceway between said decor strip and said upright member.

11. A support system as defined in claim 1 wherein said upright member and said decor strips comprise extrusions.

12. A support system as defined in claim 1 wherein each of said decor strips comprises dual-durometer polyvinyl chloride, wherein said margin portions are of a first durometer and the remaining portion of said strip is of a second, higher durometer.

13. A modular support system comprising:

an upright member;

a plurality of elongated shrouds each including first and second flexible margin portions terminating in first and second edges, respectively, said edges extending longitudinally of said shrouds, said shrouds being releasably mounted on said upright member with each of said edges generally proximate an edge of another shroud to generally hide said upright member, each of said shrouds being fabricated of a dual durometer material including a first portion having a first durometer and a second portion having a second lower durometer, said second portion comprising said margin portions.

14. A modular support system as defined in claim 13 wherein at least one of said shrouds defines a longitudinal recess generally throughout its length opening toward said upright member to define a wire raceway between said shroud and said upright member.

15. A modular support system as defined in claim 14 wherein at least one of said upright member and said one shroud includes means for spacing a portion of said one shroud from said upright member to define said wire raceway.

16. A modular support system as defined in claim 15 wherein said means for spacing comprises a bumper extending from said one shroud and engaging said upright member.

17. A modular support system comprising:

an upright member;

a plurality of elongated shrouds each including first and second edges extending longitudinally of said shrouds;

a plurality of shroud clips mounted on said upright member, each of said shroud clips including means for releasably securing one of said shrouds, whereby said shrouds can be releasably mounted on said clips in edge-to-edge relation to generally hide said upright member.

18. A modular support system as defined in claim 17 wherein each of said shrouds further includes first and second flexible margin portions adjacent said first and second edges, repsectively, whereby said margin portions can flex to receive a lateral member between two adjacent shrouds.

19. A modular support system as defined in claim 18 wherein each of said shrouds is fabricated of a dual durometer material including a first durometer portion and a second lower durometer portion comprising said margin portions.

20. A modular support system as defined in claim 17 wherein at least one of said shrouds defines a longitudinal recess generally throughout its length opening toward said upright member to define a wire raceway between said shroud and said upright member.

21. A modular support system as defined in claim 20 wherein at least one of said upright member and said one shroud includes means for spacing a portion of said one shroud from said upright member to define said wire raceway.

22. A modular support system as defined in claim 21 wherein said means for spacing comprises a bumper extending from said one shroud and engaging said upright member.

23. A modular support system comprising:

a tubular upright member generally octagonal in cross section, four alternating sides of said octagonal cross section including means for receiving lateral members, four other alternating sides of said octagonal cross section including means for receiving shroud means; and a plurality of shrouds each including first and second edges extending longitudinally of said shrouds, one of said shrouds being mounted on said shroud-receiving means on each of said four other sides of said upright member with each of said shroud edges proximate an edge of another shroud to hide said upright member.

24. A modular support system as defined in claim 23 wherein each of said shrouds further includes first and second flexible margin portions adjacent said first and second edges, respectively, whereby said margin portions can flex to receive a lateral member between two adjacent shrouds.

25. A modular support system as defined in claim 24 wherein each of said shrouds is fabricated of a dual durometer material including a first durometer portion and a second lower durometer portion comprising said margin portions.

26. A modular support system as defined in claim 23 wherein said shrouds are releasably mounted on said shroud-receiving means.

27. A modular support system as defined in claim 26 wherein at least one of said shrouds defines a longitudinal recess generally throughout its length opening toward said upright member to define a wire raceway between said shroud and said upright member.

28. A modular support system as defined in claim 27 wherein at least one of said upright member and said one shroud includes means for spacing a portion of said one shroud from said upright member to define said wire raceway.

29. A modular support system as defined in claim 28 wherein said means for spacing comprises a bumper extending from said one shroud and engaging said upright member.

* * * * *